US010247119B1

(12) United States Patent
Borgia et al.

(10) Patent No.: US 10,247,119 B1
(45) Date of Patent: Apr. 2, 2019

(54) BYPASS ACTUATION DETECTION DURING LOW-EFFICIENCY INDICATION OF EXHAUST GAS RECIRCULATION SYSTEM

(71) Applicant: GM Global Technology Operations LLC, Detroit, MI (US)

(72) Inventors: Luca Borgia, Forno Canavese (IT); Giovanni Basso, Turin (IT); Michele Meloni, Turin (IT)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 15/790,620

(22) Filed: Oct. 23, 2017

(51) Int. Cl.

| | |
|---|---|
| ***F02D 41/00*** | (2006.01) |
| ***F02M 26/26*** | (2016.01) |
| *F02M 26/33* | (2016.01) |
| *F02M 26/49* | (2016.01) |
| *F02M 26/25* | (2016.01) |
| *F02M 26/47* | (2016.01) |

(52) U.S. Cl.
CPC ..... *F02D 41/0077* (2013.01); *F02M 26/26* (2016.02); *F02D 2041/0067* (2013.01); *F02M 26/25* (2016.02); *F02M 26/33* (2016.02); *F02M 26/47* (2016.02); *F02M 26/49* (2016.02)

(58) Field of Classification Search
CPC ..... F02D 41/0077; F02D 41/0047; F02D 41/1401; F02D 41/0065; F02D 2021/083; F02D 2041/0067; F02M 26/48; F02M 26/52; F02M 26/70; F02M 26/26; F02M 26/25; F02M 26/33; F02M 26/05; F02M 26/47; F02M 26/49; Y02T 10/47
See application file for complete search history.

(56) References Cited

U.S. PATENT DOCUMENTS

| | | | | |
|---|---|---|---|---|
| 2006/0042608 | A1* | 3/2006 | Buck | F02B 29/0437 123/568.12 |
| 2012/0096855 | A1* | 4/2012 | Farmer | F02D 41/0072 60/605.2 |
| 2012/0290190 | A1* | 11/2012 | Kim | F02M 26/49 701/102 |
| 2013/0124070 | A1* | 5/2013 | Michel | F02D 41/0065 701/105 |
| 2013/0186074 | A1* | 7/2013 | Kanba | F01N 3/2033 60/286 |
| 2016/0123278 | A1* | 5/2016 | McKay | F02D 41/0065 123/568.11 |
| 2016/0305356 | A1* | 10/2016 | Iwata | F02D 41/403 |
| 2017/0130660 | A1* | 5/2017 | Gates | F02M 26/47 |
| 2018/0171898 | A1* | 6/2018 | Ulrey | F02M 26/04 |

* cited by examiner

*Primary Examiner* — Hai H Huynh
*Assistant Examiner* — Gonzalo Laguarda
(74) *Attorney, Agent, or Firm* — Cantor Colburn LLP

(57) ABSTRACT

A system and method to perform bypass actuation detection includes alternating control of a bypass valve within an exhaust gas recirculation (EGR) system of a vehicle to direct flow of gas through a cooler module or a bypass module within the EGR system. The method also includes determining a position of an EGR valve that directs the gas into the EGR system, and verifying operation of the bypass valve based on the position of the EGR valve.

18 Claims, 3 Drawing Sheets

BYPASS ACTUATION DETECTION DURING LOW-EFFICIENCY INDICATION OF EXHAUST GAS RECIRCULATION SYSTEM

INTRODUCTION

The subject disclosure relates to bypass actuation detection during a low-efficiency indication of an exhaust gas recirculation (EGR) system.

In internal combustion engines, such as a diesel engine, for example, an EGR system may function to reduce nitrogen oxide (NOx) emission. Many vehicles (e.g., automobiles, trucks, construction equipment, farm equipment) use internal combustion engines. The EGR system recirculates a portion of engine exhaust gas back to the engine cylinders, diluting the oxygen in the incoming air stream and providing gases inert to combustion to act as absorbents to combustion heat. This reduces peak in-cylinder temperatures which are needed along with high cylinder pressures to produce NOx. An EGR system may have two different paths—one through a cooler module and one through a bypass module—such that the gases through the EGR system are sometimes cooled in addition to being recirculated. Over time, as the EGR system becomes clogged with soot, efficiency of the cooler module decreases such that the temperature reduction of gases that go through the EGR cooler module decreases. When this happens, the temperature differential that is typically used to discern whether gases followed a path through the EGR cooler module or the EGR bypass module is less effective. Thus, a bypass actuation detection is needed during a low-efficiency indication of the EGR system.

SUMMARY

In one exemplary embodiment, a method of performing bypass actuation detection includes alternating control of a bypass valve within an exhaust gas recirculation (EGR) system of a vehicle to direct flow of gas through a cooler module or a bypass module within the EGR system. The method also includes determining a position of an EGR valve that directs the gas into the EGR system, and verifying operation of the bypass valve based on the position of the EGR valve.

In addition to one or more of the features described herein, the determining the position of the EGR valve includes using a position sensor.

In addition to one or more of the features described herein, the verifying includes determining whether the position of the EGR valve indicates that the EGR valve is more open when the flow is through the cooler module than when the flow is through the bypass module.

In addition to one or more of the features described herein, the method includes determining that efficiency of the cooler module is below a threshold value prior to the verifying the operation of the bypass valve.

In addition to one or more of the features described herein, the determining that the efficiency of the cooler module is below the threshold value includes controlling the bypass valve to direct the flow of the gas through the cooler module.

In addition to one or more of the features described herein, the determining that the efficiency of the cooler module is below the threshold value further includes determining temperature of the gas at an input of the EGR system and at an output of the cooler module.

In addition to one or more of the features described herein, the method includes issuing information that the efficiency of the cooler module is below the threshold value based on the verifying indicating that the operation of the bypass valve is correct.

In addition to one or more of the features described herein, the method includes issuing information that the bypass valve operation is not correct based on the verifying indicating that the operation of the bypass valve is not correct.

In another exemplary embodiment, a system to perform bypass actuation detection includes an EGR valve that directs gas into an exhaust gas recirculation (EGR) system of a vehicle. The system also includes a bypass valve within the EGR system, and a controller to alternate control of the bypass valve to direct flow of the gas through a cooler module or a bypass module within the EGR system, determine a position of the EGR valve for each change in the control of the bypass valve, and verify operation of the bypass valve based on the position of the EGR valve.

In addition to one or more of the features described herein, a position sensor is coupled to the EGR valve to provide the position of the EGR valve.

In addition to one or more of the features described herein, the controller is configured to determine whether the position of the EGR valve indicates that the EGR valve is more open when the flow of the gas is through the cooler module than when the flow of the gas is through the bypass module.

In addition to one or more of the features described herein, the controller determines that efficiency of the cooler module is below a threshold value prior to verifying the operation of the bypass valve.

In addition to one or more of the features described herein, the controller determines that the efficiency of the cooler module is below the threshold value based on controlling the bypass valve to direct the flow of the gas through the cooler module.

In addition to one or more of the features described herein, the controller determines temperature of the gas at an input of the EGR system and at an output of the cooler module to determine that the efficiency of the cooler module is below the threshold value.

In addition to one or more of the features described herein, the controller issues information that the efficiency of the cooler module is below the threshold value based on verifying that the operation of the bypass valve is correct.

In addition to one or more of the features described herein, the controller issues information that the bypass valve operation is not correct based on verifying that the operation of the bypass valve is not correct.

In addition to one or more of the features described herein, the EGR valve includes a direct current (dc) motor.

In addition to one or more of the features described herein, the bypass valve is a pneumatic valve.

In addition to one or more of the features described herein, the controller is an electronic control unit (ECU) that controls various operations of the vehicle.

In addition to one or more of the features described herein, the controller includes an electronic control unit (ECU) that controls various operations of the vehicle and processing circuitry coupled to the ECU.

The above features and advantages, and other features and advantages of the disclosure are readily apparent from the following detailed description when taken in connection with the accompanying drawings.

BRIEF DESCRIPTION OF THE DRAWINGS

Other features, advantages and details appear, by way of example only, in the following detailed description, the detailed description referring to the drawings in which.

DETAILED DESCRIPTION

Figure 1:
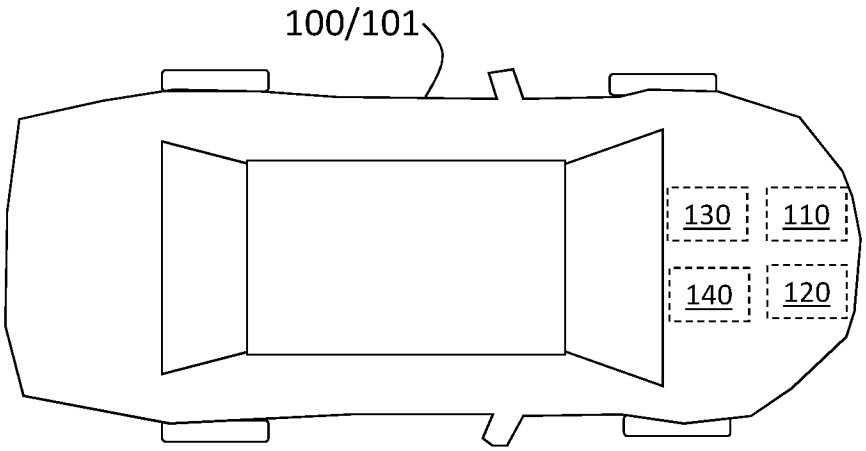
FIG. 1 is a block diagram of a vehicle with an exhaust gas recirculation (EGR) system coupled to an internal combustion engine according to one or more embodiments.

The following description is merely exemplary in nature and is not intended to limit the present disclosure, its application or uses. It should be understood that throughout the drawings, corresponding reference numerals indicate like or corresponding parts and features.

As previously noted, an EGR system of an internal combustion engine reduces NOx emission by reducing the peak temperature in the cylinders. The EGR system accomplishes this temperature reduction by reintroducing a portion of engine exhaust gas back to the engine cylinders. As also noted, the EGR system may have a path that further cools the exhaust gas via a cooler module and a path that simply diverts the exhaust gas via a bypass module (e.g., a pipe). Each of the paths of the EGR system may be preferable under different circumstances, and, under certain conditions, the cooler module must be avoided. For example, in low load conditions or when the gas temperature is below a specified value, the bypass module path may be preferable. Also, when the coolant temperature is below a specified value, directing gas through the cooler may result in undesirable hydrocarbon condensation such that the bypass module path is preferred. A bypass valve is actuated to control the path taken by the exhaust gas in the EGR system at a given time. Typically, this bypass valve does not include a position sensor that facilitates verification of the valve operation.

The efficiency of the cooler module of the EGR system must be monitored so that the cooler may be replaced or repaired when it is no longer functioning as it should. A diagnostic trouble code (DTC) may be issued when the cooling efficiency is estimated to be lower that a defined threshold. Typically, the difference between the temperature of gas entering the EGR system and the temperature of the gas exiting the cooler module of the EGR system is used to assess the cooling efficiency. When the temperature difference indicates an efficiency that is at or above the specified threshold, the functioning of the bypass valve is verified. This is because the bypass module cannot achieve the cooling efficiency specified by the threshold for the cooler module. Thus, when the bypass valve is controlled to direct the flow of gas through the cooler module and the temperature at the output of the cooler module is sufficiently lowered according to the specified efficiency, then the bypass value must necessarily have directed the gas through the (sufficiently efficient) cooler module rather than through the bypass module.

However, when this temperature difference indicates an efficiency below the specified threshold, the correct functioning of the bypass valve comes into question. This is because, when the bypass valve is not functioning correctly, the gas may flow through the bypass module even though the bypass valve is controlled to direct flow through the cooler module. In this case, the temperature of the gas at the output of the cooler module would mistakenly indicate inefficient cooler operation even though the gas did not actually flow through the cooler module. That is, during low-efficiency operation of the EGR cooler, there may be an overlap in EGR cooler and EGR bypass efficiency such that temperature of the gas exiting the EGR system does not indicate which path was taken through the EGR system. Thus, verifying the proper functioning of the bypass valve facilitates verification of the efficiency determination. Because the bypass valve does not include a flap position sensor or other direct means of indicating valve operation and the temperature difference cannot be relied on to indicate the flow path, bypass valve operation must be verified in another way.

Embodiments of the systems and methods detailed herein relate to bypass actuation detection during a low-efficiency indication of the EGR cooler. Specifically, when an efficiency below the specified threshold is indicated for the cooler module, a pressure differential rather than a temperature differential is used to determine which path the gas took, as further detailed. By ensuring that the DTC indicating inefficient cooler operation is issued based on efficiency determination only when the gas is actually flowing through the cooler module, unnecessary repair or replacement of the cooler module may be avoided.

In accordance with an exemplary embodiment, FIG. 1 is a block diagram of a vehicle 100 with an EGR system 110 coupled to an internal combustion engine 120. The vehicle 100 shown in FIG. 1 is an automobile 101. The vehicle 100 is shown with processing circuitry 130 and an electronic control unit (ECU) 140. The processing circuitry 130 is shown and discussed separately for explanatory purposes regarding the bypass actuation detection. However, the processing circuitry 130 may be part of or coupled to other systems of the vehicle 100. For example, the processing circuitry 130 may be part of the EGR system 110 or may be coupled to the EGR system 110 and the various sensors that are discussed as being part of the EGR system 110 in the discussion of FIG. 2. The processing circuitry may instead be part of the ECU 140 or may be coupled to the ECU 140 to obtain information regarding the EGR system 110 components and provide information regarding the bypass actuation. The ECU 140 controls the EGR valve 230 (FIG. 2) and the bypass valve 240 (FIG. 2) of the EGR system 110 in addition to controlling various vehicle operations. The processing circuitry 130 and ECU 140 may include an application specific integrated circuit (ASIC), an electronic circuit, a processor (shared, dedicated, or group) and memory that executes one or more software or firmware programs, a combinational logic circuit, and/or other suitable components that provide the described functionality.

Figure 2:
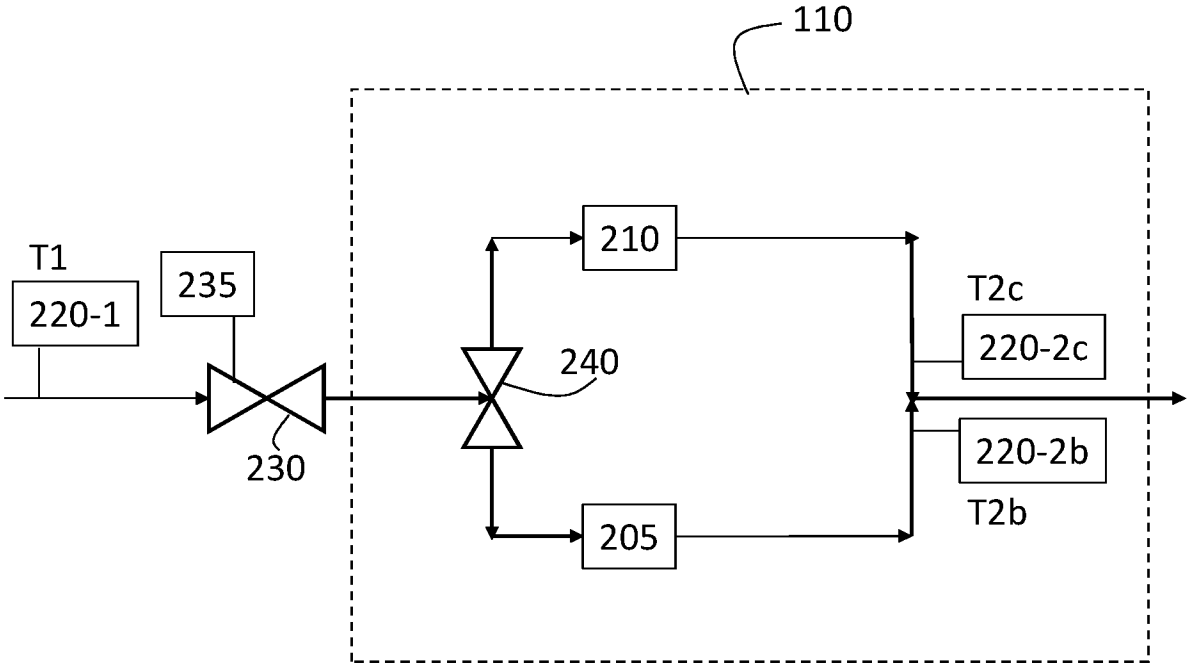
FIG. 2 details the EGR system shown in FIG. 1 according to one or more embodiments.

FIG. 2 details the EGR system 110 shown in FIG. 1 according to one or more embodiments. The EGR system 110 includes a cooler module 210 and a bypass module 205. The cooler module 210 is a known cooler. According to exemplary embodiments, the cooler module 210 operates on the principle of heat exchange by conduction. The gases in the cooler module 210 dissipate heat to a coolant (e.g., water and glycol). The bypass module 205 may simply be a pipe, for example. An EGR valve 230 is used to control the flow of gas into the EGR system 110. The EGR valve 230 may be actuated by a direct current (dc) motor. As such, the amount that the EGR valve 230 opens is based on a pressure differential within the EGR system 110, as further detailed. A position sensor 235 is used to determine how much the EGR valve 230 is opened. The EGR valve 230 may be controlled by the ECU 140. This control may be affected by information (e.g., an efficiency determination for the cooler module 210) from the processing circuitry 130, in addition to known ways of controlling the EGR valve 230.

A bypass valve 240 is used to control flow of gas within the EGR system 110 to either be through the cooler module 210 or through the bypass module 205. The bypass valve 240 may be a pneumatic valve that is controlled to be in one of two positions by the ECU 140 based on information from the processing circuitry 130 (e.g., cooler module 210 efficiency) or other information (e.g., load level).

Known temperature sensors 220-1, 220-2*b*, 220-2*c* (generally referred to as 220) are used to measure the temperature of exhaust gas at different parts of the EGR system 110. The temperature sensor 220-1 measures the temperature T1 of the exhaust gas at it enters the EGR valve 230. The temperature sensor 220-2*b* measures the temperature T2*b* of the exhaust gas at the output of the bypass module 205, and the temperature sensor 220-2*c* measure the temperature T2*c* of the exhaust gas at the output of the cooler module 210. In alternate embodiments, one temperature sensor 220 may measure the temperature of gas at the output of the EGR system 110, whether the gas passed through the cooler module 210 or the bypass module 205.

When the EGR valve 230 is set to direct exhaust gas into the EGR system 110 and the bypass valve 240 is set to direct the exhaust gas into the cooler module 210, the temperatures T1 and T2*c* are used to determine the efficiency of the cooler module 210. When the efficiency is determined to be at or above the threshold value, then the functioning of the bypass valve 240 in actually sending exhaust gas through the cooler module 210 is not in question. This is because the drop in temperature of the exhaust gas required to make the value of T2*c* low enough for the efficiency to be at or above the required threshold level is not possible if the exhaust gas instead passed through the bypass module 205. Also T2*c* is much lower than T2*b* when the gas flows through the cooler module 210 and the cooler module 210 efficiency is sufficiently high.

If, on the other hand, the efficiency is determined to be below a threshold value, then verifying the functioning of the bypass valve 240 is important to ensuring that unnecessary actions are not taken. For example, a lower than threshold efficiency of the cooler module 210 may lead the EGR valve 230 to divert gas so that it does not flow into the EGR system 110. As another example, a DTC may be issued to trigger repair or replacement of the cooler module 210. To prevent these actions from being taken unnecessarily, the functionality of the bypass valve 240 must be verified.

If the bypass valve 240 is set to control the flow of gas through the cooler module 210, and the efficiency is determined to be below a threshold value, then T2*c* and T2*b* may be nearly the same. However, the similarity in temperature at the output of the cooler module 210 and the bypass module 205 may mean one of two different conditions. The similarity in T2*c* and T2*b* may mean that the flow of gas was, in fact, through the cooler module 210 as it should have been and the efficiency of the cooler module 210 is, in fact, below the specified threshold. On the other hand, the similarity in T2*c* and T2*b* may mean that the flow of gas was through the bypass module 205 even though it should have been through the cooler module 210, according to the setting of the bypass valve 240. Thus, the cooler module 210 did not have an opportunity to cool the gas and reduce T2*c* at all.

As the description of the two conditions indicates, the temperatures T2*b* and T2*c* are not helpful in determining which of the conditions has occurred. Instead, pressure difference is used to verify the functioning of the bypass valve 240 even though pressure sensors are not used and are not needed. When the cooler module 210 efficiency is at or above the threshold value, the pressure difference (from the bypass valve 240 to the output of the cooler module 210 ($\Delta Pc$) or from the bypass valve 240 to the output of the bypass module 205 ($\Delta Pb$)) is nearly the same or $\Delta Pb$ is slightly higher than $\Delta Pc$. However, when efficiency of the cooler module 210 drops below the threshold, $\Delta Pc$ increases to a much higher value than $\Delta Pb$. As a result, the EGR valve 230 opens more when flow is through the (inefficient) cooler module 210 than through the bypass module 205. This difference in the opening of the EGR valve 230, as determined by the position sensor 235, may be used to verify the functioning of the bypass valve 240.

Figure 3:
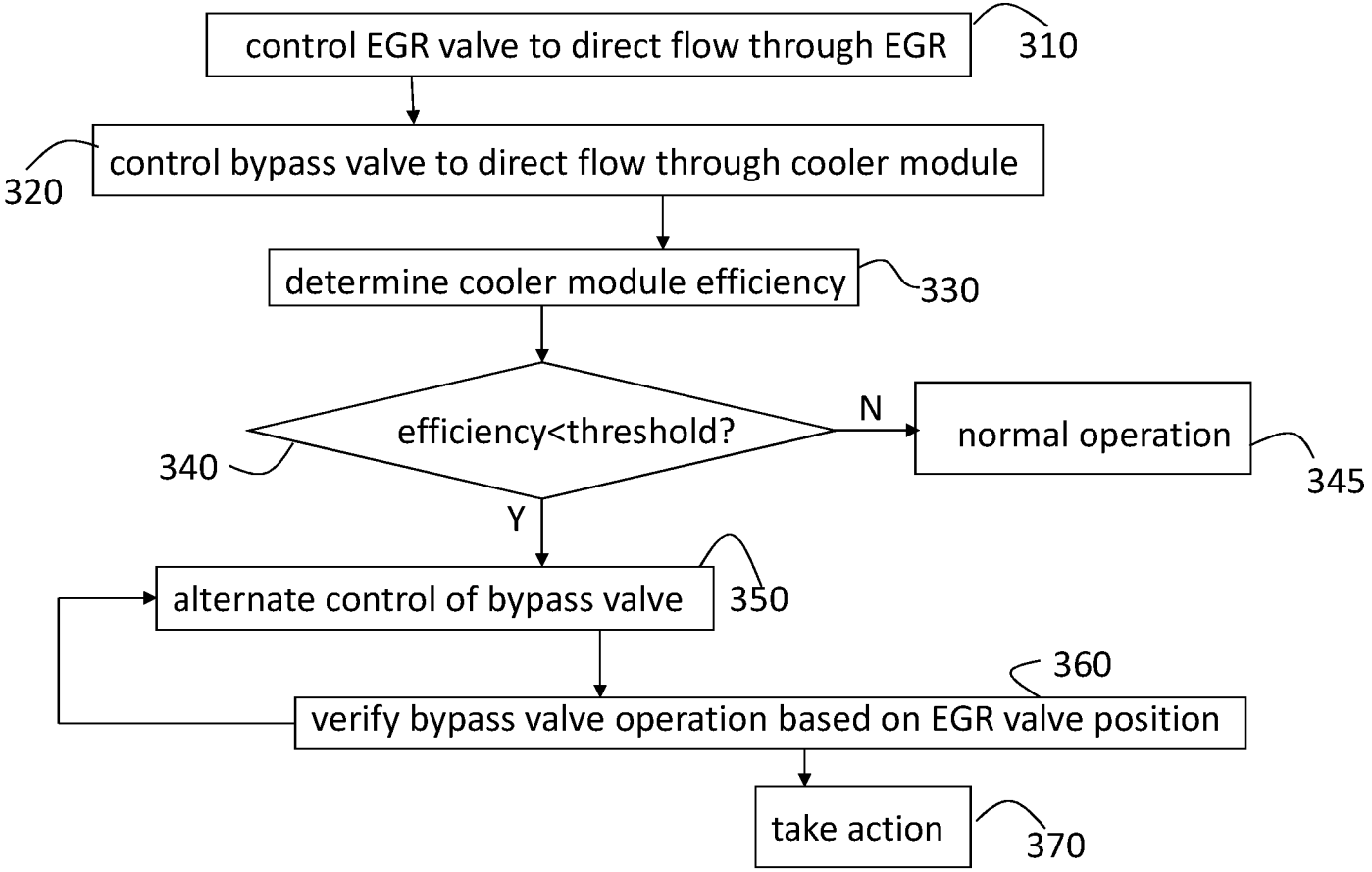
FIG. 3 shows a process flow of a method of performing bypass actuation detection during low-efficiency indication of the EGR system according to one or more embodiments.

FIG. 3 shows a process flow of a method of performing bypass actuation detection during low-efficiency indication of the EGR system 110 according to one or more embodiments. At block 310, controlling the EGR valve 230 to direct the flow of gas through the EGR system 110 involves the ECU 140 which may include or be coupled to the processing circuitry 130. Controlling the bypass valve 240 to direct flow through the cooler module 210, at block 320, involves the ECU 140 setting the pneumatic valve. At block 330, determining cooler module 210 efficiency refers to examining the temperature T1 of gas at it enters the EGR system 110 and the temperature T2*c* of gas at the output of the cooler module 210 using the temperature sensors 220-1 and 220-2*c*, respectively. The efficiency may be determined by the processing circuitry 130 within or coupled to the ECU 140 according to exemplary embodiments.

At block 340, a determination is made by the processing circuitry 130 of whether the efficiency of the cooler module 210 is below the established threshold. If the efficiency is not below the threshold, then normal operation is resumed at block 345. If the efficiency is determined to be below the threshold, at bloc 340, the correct operation of the bypass valve 240 must be verified according to the processes at blocks 350 and 360, which are performed iteratively, as shown. The number of times that the processes at blocks 350 and 360 are repeated may be predefined and controlled by the ECU 140 in combination with the processing circuitry 130.

At block 350, alternating control of the bypass valve 240 refers to changing the direction of gas flow determined by the bypass valve 240. For example, because gas flow is initially to the cooler module 210 when the efficiency determination is made, the first iteration of the process at block 350 may involve changing the bypass valve 240 position to control flow to be through the bypass module 205 instead. The next iteration of the process at block 350 would involve changing the bypass valve 240 position back to directing the flow of gas through the cooler module 210.

Each time the flow of gas is changed between a path through the cooler module 210 and a path through the bypass module 205, at block 350, the process at block 360 is performed. At block 360, verifying bypass valve 240 operation based on the EGR valve 230 position refers to using the position sensor 235. When the bypass valve 240 is supposed to direct flow through the cooler module 210, the position sensor 235 should indicate that the EGR valve 230 is open more than when the bypass valve 240 is supposed to direct flow through the bypass module 205. This is because of the previously discussed difference in the pressure drop of the paths through the cooler module 210 and the bypass module 205.

When the bypass valve 240 operation is verified, at block 360, taking action, at block 370, may include issuing the DTC indicating the drop in efficiency of the cooler module 210. When the bypass valve 240 is found not to be operating correctly, at block 360, then taking action, at block 370, may include issuing a DTC to indicate bypass valve 240 malfunction.

While the above disclosure has been described with reference to exemplary embodiments, it will be understood by those skilled in the art that various changes may be made and equivalents may be substituted for elements thereof without departing from its scope. In addition, many modifications may be made to adapt a particular situation or material to the teachings of the disclosure without departing from the essential scope thereof. Therefore, it is intended that the present disclosure not be limited to the particular embodiments disclosed, but will include all embodiments falling within the scope thereof.

What is claimed is:

1. A method of performing bypass actuation detection, the method comprising:

alternating control of a bypass valve within an exhaust gas recirculation (EGR) system of a vehicle to direct flow of gas through a cooler module or a bypass module within the EGR system;

determining a position of an EGR valve that directs the gas into the EGR system; and verifying operation of the bypass valve based on the position of the EGR valve, wherein the verifying includes determining whether the position of the EGR valve indicates that the EGR valve is more open when the flow is through the cooler module than when the flow is through the bypass module.

2. The method according to claim 1, wherein the determining the position of the EGR valve includes using a position sensor.

3. The method according to claim 1, further comprising determining that efficiency of the cooler module is below a threshold value prior to the verifying the operation of the bypass valve.

4. The method according to claim 3, wherein the determining that the efficiency of the cooler module is below the threshold value includes controlling the bypass valve to direct the flow of the gas through the cooler module.

5. The method according to claim 4, wherein the determining that the efficiency of the cooler module is below the threshold value further includes determining temperature of the gas at an input of the EGR system and at an output of the cooler module.

6. The method according to claim 3, further comprising issuing information that the efficiency of the cooler module is below the threshold value based on the verifying indicating that the operation of the bypass valve is correct.

7. The method according to claim 3, further comprising issuing information that the bypass valve operation is not correct based on the verifying indicating that the operation of the bypass valve is not correct.

8. A system to perform bypass actuation detection, the system comprising:

an EGR valve that directs gas into an exhaust gas recirculation (EGR) system of a vehicle;

a bypass valve within the EGR system; and a controller configured to alternate control of the bypass valve to direct flow of the gas through a cooler module or a bypass module within the EGR system, determine a position of the EGR valve for each change in the control of the bypass valve, and verify operation of the bypass valve based on the position of the EGR valve, wherein the controller is further configured to determine whether the position of the EGR valve indicates that the EGR valve is more open when the flow of the gas is through the cooler module than when the flow of the gas is through the bypass module.

9. The system according to claim 8, further comprising a position sensor coupled to the EGR valve to provide the position of the EGR valve.

10. The system according to claim 8, wherein the controller is further configured to determine that efficiency of the cooler module is below a threshold value prior to verifying the operation of the bypass valve.

11. The system according to claim 10, wherein the controller is further configured to determine that the efficiency of the cooler module is below the threshold value based on controlling the bypass valve to direct the flow of the gas through the cooler module.

12. The system according to claim 11, wherein the controller is further configured to determine temperature of the gas at an input of the EGR system and at an output of the cooler module to determine that the efficiency of the cooler module is below the threshold value.

13. The system according to claim 10, wherein the controller is further configured to issue information that the efficiency of the cooler module is below the threshold value based on verifying that the operation of the bypass valve is correct.

14. The system according to claim 10, wherein the controller is further configured to issue information that the bypass valve operation is not correct based on verifying that the operation of the bypass valve is not correct.

15. The system according to claim 8, wherein the EGR valve includes a direct current (dc) motor.

16. The system according to claim 8, wherein the bypass valve is a pneumatic valve.

17. The system according to claim 8, wherein the controller is an electronic control unit (ECU) that controls various operations of the vehicle.

18. The system according to claim 8, wherein the controller includes an electronic control unit (ECU) that controls various operations of the vehicle and processing circuitry coupled to the ECU.

* * * * *